US005434589A

United States Patent [19]

Nakamura et al.

[11] Patent Number: 5,434,589

[45] Date of Patent: Jul. 18, 1995

[54] TFT LCD DISPLAY CONTROL SYSTEM FOR DISPLAYING DATA UPON DETECTION OF VRAM WRITE ACCESS

[75] Inventors: Nobutaka Nakamura; Hiroki Zenda, both of Tokyo, Japan

[73] Assignee: Kabushiki Kaisha Toshiba, Kawasaki, Japan

[21] Appl. No.: 190,217

[22] Filed: Feb. 1, 1994

Related U.S. Application Data

[63] Continuation of Ser. No. 815,785, Jan. 2, 1992, abandoned.

[30] Foreign Application Priority Data

Jan. 8, 1991 [JP] Japan ..... 3-000538

[51] Int. Cl.[6] ..... G09G 3/36

[52] U.S. Cl. ..... 345/98; 345/87; 345/185

[58] Field of Search ..... 345/185, 200, 189, 190, 345/87, 92, 98, 10

[56] References Cited

U.S. PATENT DOCUMENTS

| | | | |
|---|---|---|---|
| 4,727,363 | 2/1988 | Ishii | 340/798 |
| 4,796,203 | 1/1989 | Roberts | 340/798 |
| 4,942,389 | 7/1990 | Hinami | 340/799 |
| 5,059,961 | 10/1991 | Cheng | 340/720 |
| 5,247,286 | 9/1993 | Ishikawa | 345/10 |

FOREIGN PATENT DOCUMENTS

| | | |
|---|---|---|
| 0256879 | 2/1988 | European Pat. Off. . |
| 0288168 | 10/1988 | European Pat. Off. . |
| 0456012 | 11/1991 | European Pat. Off. . |

OTHER PUBLICATIONS

Japanese Video Catalog document, "A New Image World", published Jan. 31, 1983 (four pages), with translation.

*Primary Examiner*—Ulysses Weldon
*Assistant Examiner*—Matthew Luu
*Attorney, Agent, or Firm*—Finnegan, Henderson, Farabow, Garrett & Dunner

[57] ABSTRACT

An electronic apparatus having a TFT LCD includes a detector for detecting whether or not display data in a video RAM is rewritten. When the rewrite operation of display data is detected, a display controller reads out display data from the video RAM, and supplies the readout display data to the TFT LCD. When data on a memory plane for storing display data, which is being displayed on the TFT LCD, is rewritten, the display controller reads out display data from the video RAM, and supplies the readout display data to the TFT LCD. When display data to be written in the Video RAM is the same as the already stored display data, the display controller does not supply the display data from the video RAM to the TFT LCD.

3 Claims, 6 Drawing Sheets

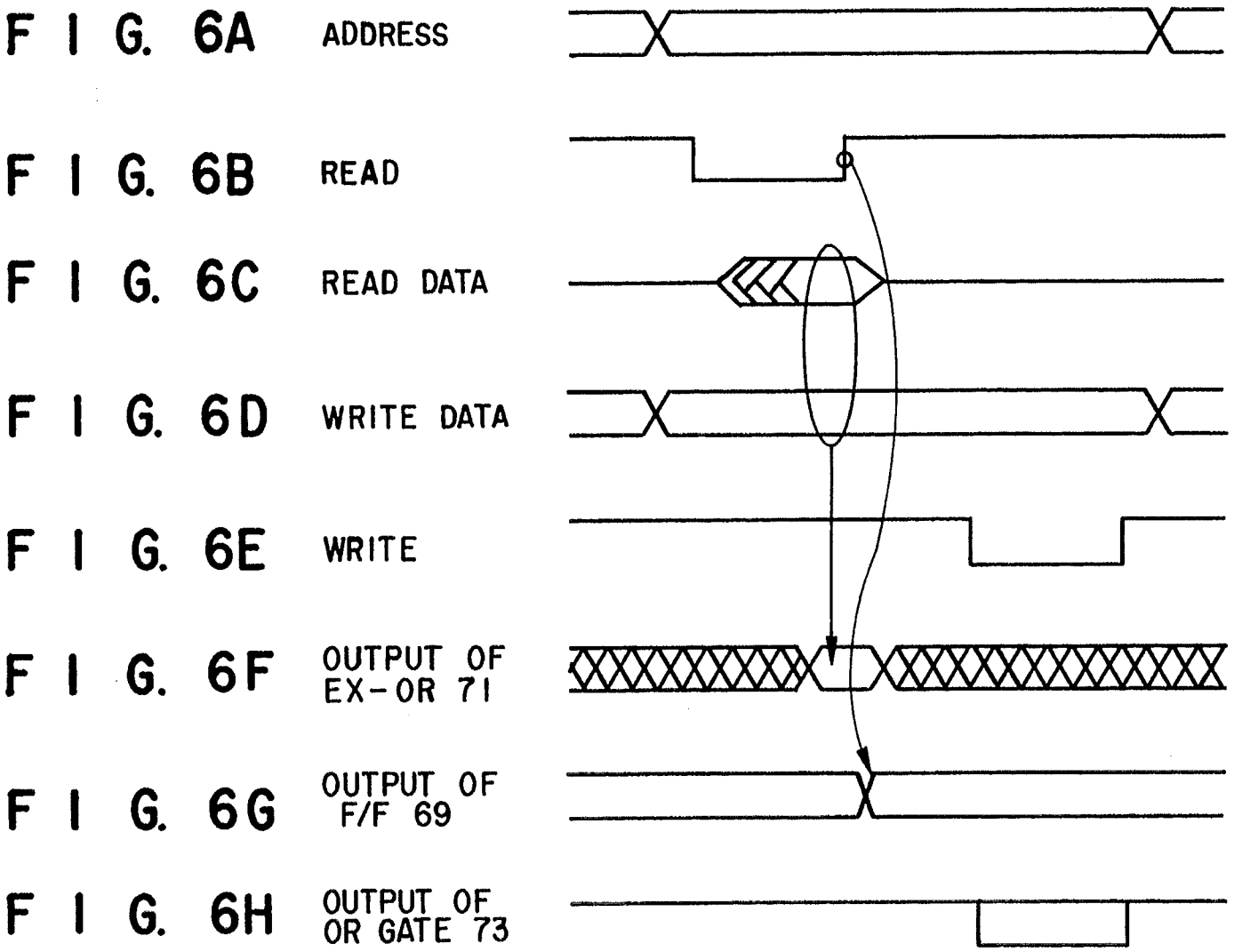
FIG. 6A ADDRESS
FIG. 6B READ
FIG. 6C READ DATA
FIG. 6D WRITE DATA
FIG. 6E WRITE
FIG. 6F OUTPUT OF EX-OR 71
FIG. 6G OUTPUT OF F/F 69
FIG. 6H OUTPUT OF OR GATE 73

TFT LCD DISPLAY CONTROL SYSTEM FOR DISPLAYING DATA UPON DETECTION OF VRAM WRITE ACCESS

This application is a continuation, of application Ser. No. 07/815,785, filed Jan. 2, 1992, now abandoned.

BACKGROUND OF THE INVENTION

1. Field of the Invention

The present invention relates to an electronic apparatus, which uses a display device such as a TFT (Thin Film Transistor) active matrix type liquid crystal display (to be referred to as a TFT LCD hereinafter) for holding display data in units of pixels.

2. Description of the Related Art

In recent years, electronic apparatuses such as personal computers have been rendered compact and lightweight, so that they can be easily carried and used anywhere. Furthermore, in order to allow a long-time use of the electronic apparatus using a battery power supply, compact, lightweight batteries having a large electric capacity, and power saving mechanisms of the electronic apparatuses have been developed.

For example, an automatic sleep mode is one of the power saving mechanisms. In this mode, when no keyboard input is detected for a predetermined period of time, a system is automatically set in a sleep state. Thereafter, when a keyboard input is detected, the system resumes a normal operation state.

In a screen display operation of a conventional electronic apparatus, which comprises a display device such as a CRT (cathode ray tube), a plasma display, an STN type LCD, or the like, a read operation of display data from a VRAM (video RAM), an output operation of display data to the display device, and a screen display on the display device are periodically performed independently of the presence/absence of a change in display content on the screen. This is because, in this display device, the screen display disappears when display data are not periodically supplied. Also, in an electronic apparatus, which comprises a display device such as a TFT LCD having a function of storing display data in units of pixels, a read operation of display data from a VRAM, an output operation of display data to the display device, and a screen display on the display device are periodically performed.

Since the TFT LCD originally had a function of storing display data in units of pixels, when the same screen display content continues, the read operation of display data from the VRAM is actually unnecessary. A state wherein the same screen display content continues occurs very frequently. For example, when a word-processor software program is used in a personal computer, an operator does not often change a screen display content when he or she is thinking while writing in front of the display screen or when the computer is executing complicated computation processing. Such a state also occurs when data on a window, which is not displayed on the screen, is rewritten in a work using a window function, or when the same data is input at the same position. However, in a conventional system, a VRAM, a display controller, and the display device are always operated to perform a screen display, and power consumption of the screen display operation cannot be reduced.

SUMMARY OF THE INVENTION

It is an object of the present invention to provide an electronic apparatus, which can save power consumption required for reading out display data from a VRAM or writing data on a display device by inhibiting a read operation of display data from the VRAM when the same screen display content is continuously displayed.

According to the first aspect of the present invention, an electronic apparatus comprises a VRAM for storing display data, a TFT LCD for holding display data output from the VRAM, and displaying the display data in units of pixels, a detector for detecting that the display data stored in the VRAM is rewritten, and a display controller for reading out when the detector detects that the display data is rewritten, the display data from the VRAM, and sending the readout display data to the TFT LCD.

According to the second aspect of the present invention, the VRAM has a first display data storage area for storing display data, which is being displayed on the TFT LCD, and a second display data storage area for storing display data, which is not displayed on the TFT LCD, and the electronic apparatus comprises a display data rewrite detector for detecting whether or not display data stored in the first display data storage area of the VRAM is rewritten, and a display controller for reading out when the rewrite detector detects that the display data in the first display data storage area is rewritten, display data from the VRAM, and sending the readout display data to the TFT LCD.

According to the third aspect of the present invention, an electronic apparatus comprises a coincidence detector for detecting whether or not rewritten data in the VRAM is the same as data before rewriting, and a display controller for reading out, when the coincidence detector detects that the rewritten data is not the same as the data before rewriting, display data from the VRAM, and sending the readout display data to the TFT LCD.

According to the present invention, the detector detects that display data in the VRAM is rewritten, and sends information indicating this to the display controller. In response to this information, the display controller reads out display data from the VRAM, and sends the readout data to the TFT LCD.

In this manner, only when display data stored in the VRAM is rewritten, display data is read out from the VRAM, thus saving power consumption.

Additional objects and advantages of the invention will be set forth in the description which follows, and in part will be obvious from the description, or may be learned by practice of the invention. The objects and advantages of the invention-may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 6A through 6H are timing charts showing timings of I/O signals of circuits shown in FIG. 5.

DETAILED DESCRIPTION OF THE PREFERRED EMBODIMENTS

Figure 1:
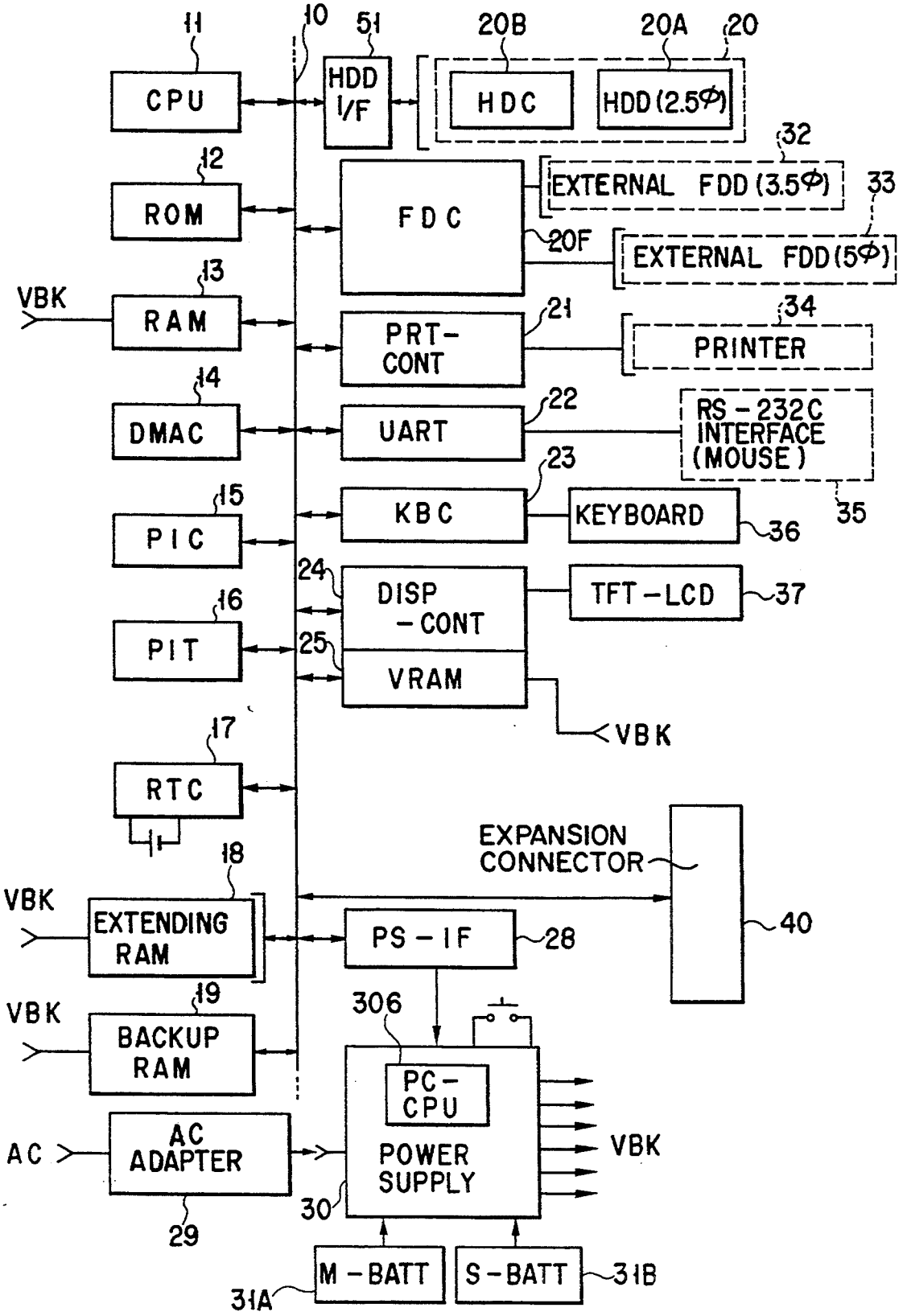
FIG. 1 is a system block diagram showing an embodiment of an electronic apparatus according to the present invention.

FIG. 1 is a system block diagram showing a portable computer as an embodiment of an electronic apparatus according to the present invention.

In FIG. 1, components 11 through 28, and 51 are connected to a system bus 10. A CPU (Central Processing Unit) 311 controls the overall system. The CPU 11 serves as a host CPU when viewed from a power control CPU 306 of a power supply 30 (to be described later). A ROM (Read Only Memory) 12 stores a BIOS (basic input and output program). The BIOS is executed in response to turn-on of a power supply of the system, and loads setup information stored in a specific area (or register) of a RAM (Random Access Memory) 13 so as to determine system environments. Thereafter, the BIOS reads out a boot block from an HDD 20A, and loads an OS (operating system program) stored in the HDD (hard disk drive) 20A into the RAM 13 using the boot block. The RAM 13 stores the OS, application programs, various data, and the like. The RAM 13 is supplied with a backup power supply voltage VBK from the power supply 30, so that its memory content can be prevented from being erased even when the system power supply is turned off. A DMA (Direct Memory Access) controller 14 performs DMA control. A controller 15 is a programmable interrupt .controller. A timer 16 is a programmable interval timer. When the interval timer 16 measures a programmed time, it supplies a time-out signal to the CPU 11 as an interrupt signal under the control of the programmable interrupt controller 15. In response to this interrupt signal, the CPU 11 executes a vector interrupt processing routine. An RTC (realtime clock) 17 is a timepiece module, having its own operation power supply, for displaying current time. An extending (expansion) RAM 18 is a large-capacity memory, which can be desirably inserted in or removed from a special-purpose card slot of a main body, and is supplied with the backup power supply voltage (VBK). A backup RAM 19 is a data preservation area for realizing a resume function, and is supplied with the backup power supply voltage (VBK). An HDD interface 51 interfaces between the CPU 11 and an HDD pack 20. The HDD pack 20 can be desirably inserted in or removed from a special-purpose storage portion of the main body, and comprises, e.g., a 2.5" HDD 20A and an HDC (hard disk controller) 20B for access-controlling the HDD 20A. An FDC (floppy disk controller) 20F controls a 3.5" external FDD (floppy disk drive) 33 connected as an optional device. A printer controller 21 is connected to a printer 34 externally connected to the main body. An I/O interface 22 is a UART (Universal Asynchronous Receiver/Transmitter), and an RS-232C interface device is connected to the I/O interface 22, as needed. A keyboard controller 23 controls a keyboard 36.

A display controller 24 controls an LCD (liquid crystal display) 37. The display controller 24 has a function of writing display data in a VRAM (video RAM) 25 upon reception of a write command from the CPU 11 to the VRAM 25, and a function of reading out display data from the VRAM 25, and supplying the readout data to the LCD 37. The LCD 37 has a function of holding display data in units of pixels like in, e.g., a TFT (Thin Film Transistor) LCD, and visually displays display data. The VRAM 25 is supplied with the backup power supply voltage (VBK), and stores video data. A power supply control interface 28 connects the power supply 30 to the CPU 11 through the system bus 10. A power supply adapter 29 is plug-in-connected to the personal computer main body so as to rectify and smooth a commercial AC power supply to obtain a DC operation power supply of a predetermined potential. An expansion unit is selectively connected to an expansion connector 40. The intelligent power supply (power supply controller) 30 comprises the power control CPU 306, and supplies electric power to the above-mentioned units. A battery 31A is a detachable main battery pack comprising a rechargeable battery. A battery 31B is a sub battery comprising a rechargeable battery, and equipped in the main body.

Figure 2:
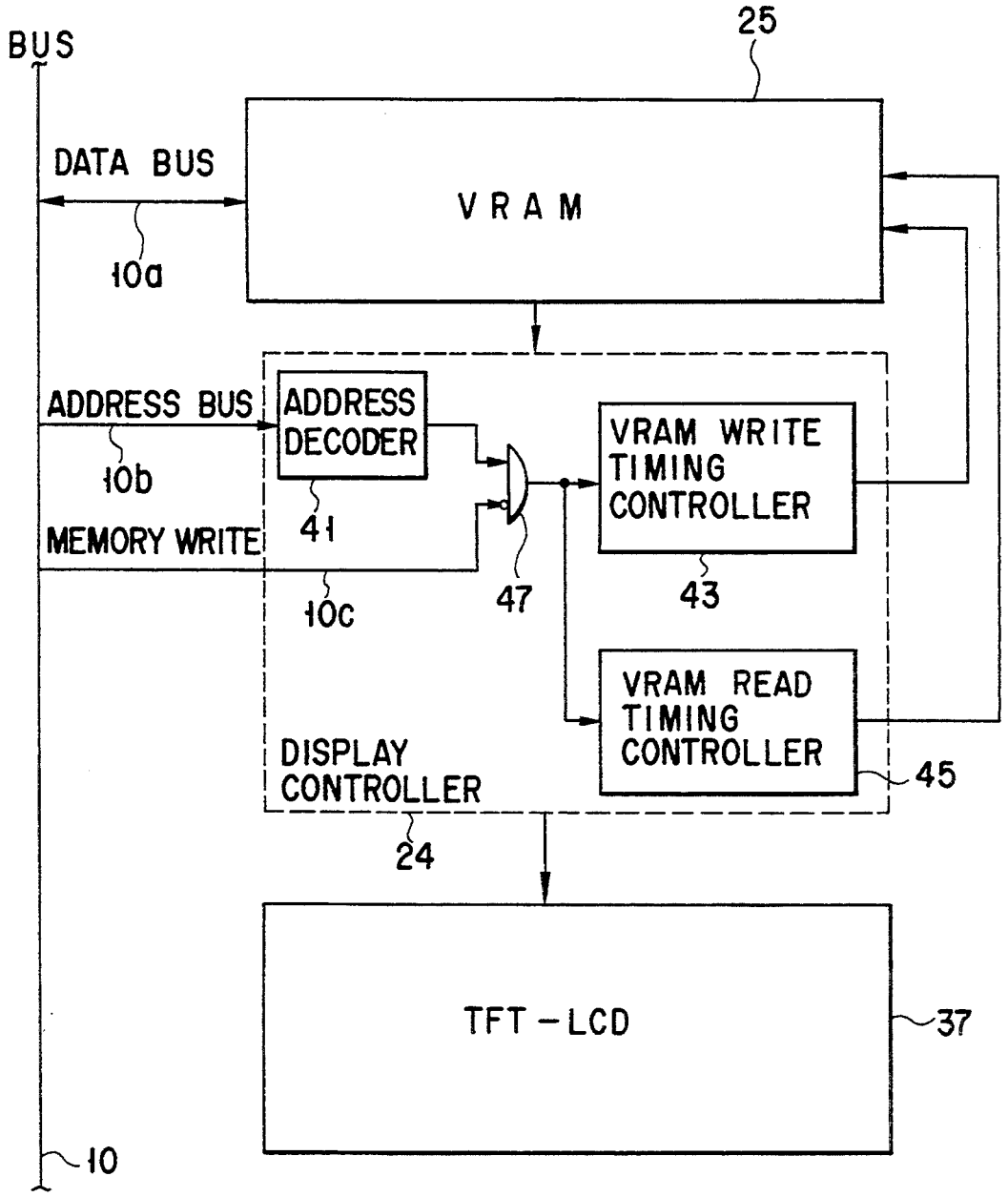
FIG. 2 is a detailed block diagram of a display controller shown in FIG. 1.

FIG. 2 is a detailed block diagram of the display controller 24 shown in FIG. 1. In FIG. 2, an address decoder 41 decodes an address signal input through an address bus 10*b*, and if the address signal indicates an address of the VRAM 25, the decoder 41 outputs a high-level signal "H". A VRAM write timing controller 43 controls write timings of display data supplied through a data bus 10*a*. A VRAM read timing controller 45 controls read timings for reading out display data from the VRAM 25. An AND gate 47 detects that the content of the VRAM 25 is rewritten. More specifically, the positive input terminal of the AND gate 47 receives 10 an output from the address decoder 41, and the negative input terminal thereof receives a memory write signal (active low). Assuming that display data stored in the VRAM 25 are rewritten, since the address decoder 41 detects an address of the VRAM 25, it supplies a high-level signal "H" to the AND gate 47. Furthermore, since the CPU 11 sets a memory write signal at low level, a high-level signal obtained by inverting the low-level memory write signal is supplied to the AND gate 47. As a result, the AND gate 47 supplies a high-level signal to the VRAM write timing controller 43 and the VRAM read timing controller 45.

An operation of the embodiment of the present invention with the above arrangement will be described below.

When the CPU 11 writes display data in the VRAM 25, it outputs an address signal and a memory write signal together with the display data. The address signal sent through the address bus 10b is supplied to the address decoder 41. The address decoder 41 decodes the supplied address signal, and outputs a high-level signal "H" only when the address signal indicates an address of the VRAM 25. The AND gate 47 receives a signal output from the address decoder 41, and the memory write signal output from the CPU 11 through a control bus 10*c*. When the output from the address decoder 41 is the high-level signal "H", and the memory write signal is the low-level signal "L", the AND gate 47 outputs a high-level signal "H" to the VRAM write timing controller 43. The high-level signal "H" indicates that the display data stored in the VRAM 25 is rewritten.

Upon reception of the high-level signal "H" from the AND gate 47, the VRAM write timing controller 43 generates a timing signal for storing the display data supplied through the data bus 10*a* at the designated address of the VRAM 25.

The output signal from the AND gate 47 is supplied to the VRAM read controller 45. When the output signal from the AND gate 47 is at high level "H", the VRAM read timing controller 45 is enabled, and generates a timing signal for reading out display data in the VRAM 25. When the output signal from the AND gate 47 is at low level "L", the VRAM read timing controller 45 is disabled.

As described above, only when display data stored in the VRAM 25 is to be changed, the display data is supplied to the LCD 37, thus saving power consumption.

Figure 3:
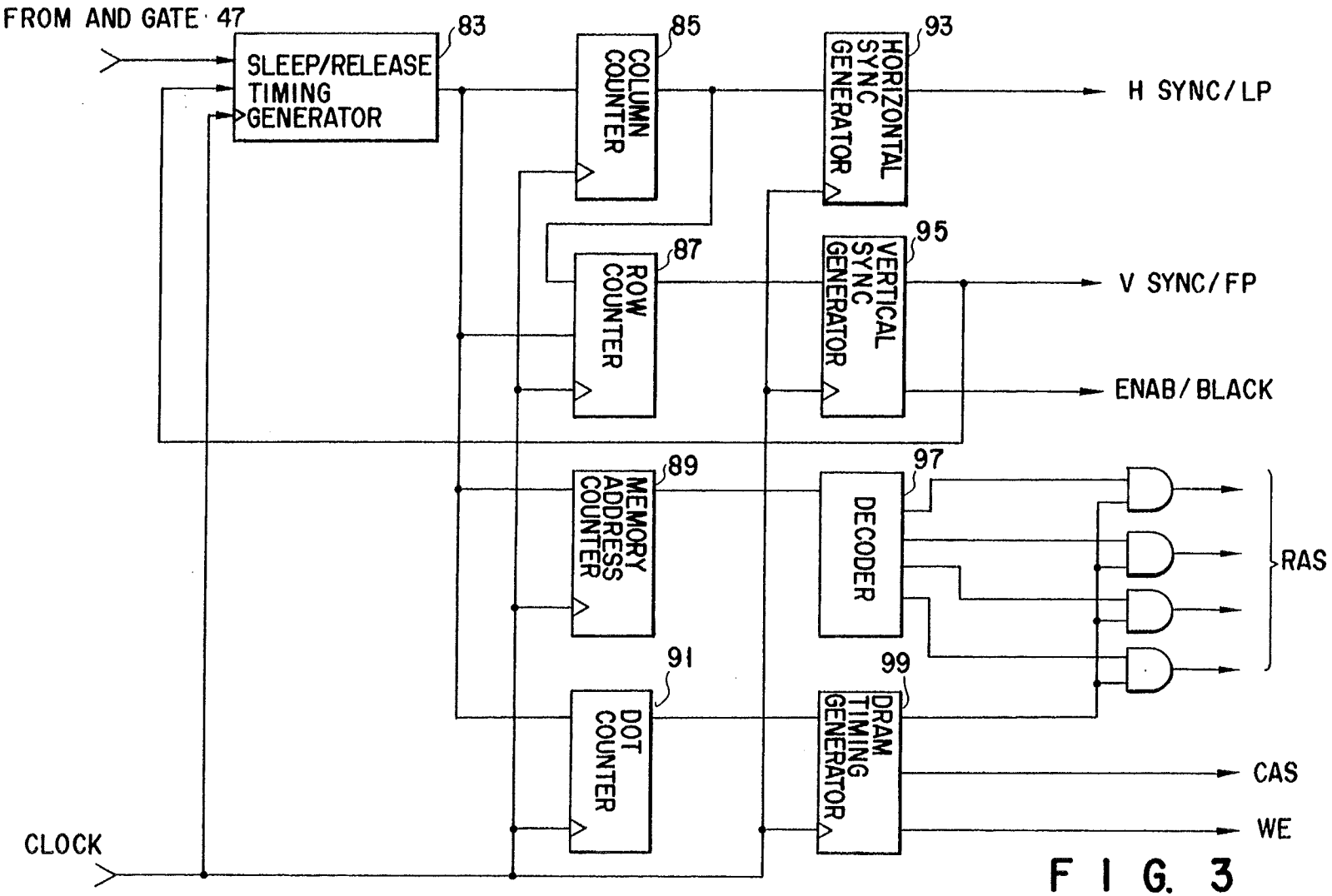
FIG. 3 is a detailed block diagram showing a controller for setting a read operation of display data in a sleep state.

FIG. 3 is a detailed block diagram of a controller for setting the VRAM read timing controller 45 in a sleep state. A sleep/release timing controller 83 receives a sleep or release signal from the AND gate 47, a clock signal from a clock circuit (not shown), and a vertical sync signal from a vertical sync generator 95 (to be described later), and outputs a sleep or release timing signal to counters 85, 87, 89, and 91 (to be described later). The column counter 85 and the row counter 87 respectively count the numbers of columns and rows of the display screen. For example, when the display resolution is 640×480 dots, the column counter 85 counts a value ranging between 0 and 639, and the row counter 87 counts a value ranging between 0 and 479. The memory address counter 89 counts an address of the VRAM 25, e.g., a value ranging between 0 and (256K−1). Furthermore, the dot counter 91 counts dots (0 through 7) of one byte. When the column counter 85 completes a count operation of "639" columns, a horizontal sync generator 93 outputs a horizontal sync signal. When the row counter 87 completes a count operation of "479" rows, the vertical sync generator 95 generates a vertical sync signal. A decoder 97 decodes an address signal from the memory address counter 89, and outputs an RAS (row address strobe) signal to respective memory chips (four chips in this embodiment). A DRAM timing generator 99 outputs a CAS (column address strobe) signal and a WE (write enable) signal on the basis of a dot count value from the dot counter 91. In a normal operation, a clock signal is supplied to the counters 85, 87, 89, and 91, and these counters are operated. Upon reception of a sleep control signal from the AND gate 47, the sleep/release timing generator 83 logically ANDs the sleep control signal and the vertical sync signal. When both 10 the signals are significant signals, the generator 83 supplies a sleep signal to the counters 85, 87, 89, and 91. As a result, the counters 85, 87, 89, and 91 are set in a sleep state. The sleep control signal from the AND gate 47 and the vertical sync signal are logically ANDed to set the counters in a sleep state not immediately after the sleep signal is supplied from the timer 81, but after the display operation of the display screen is completed.

Figure 4:
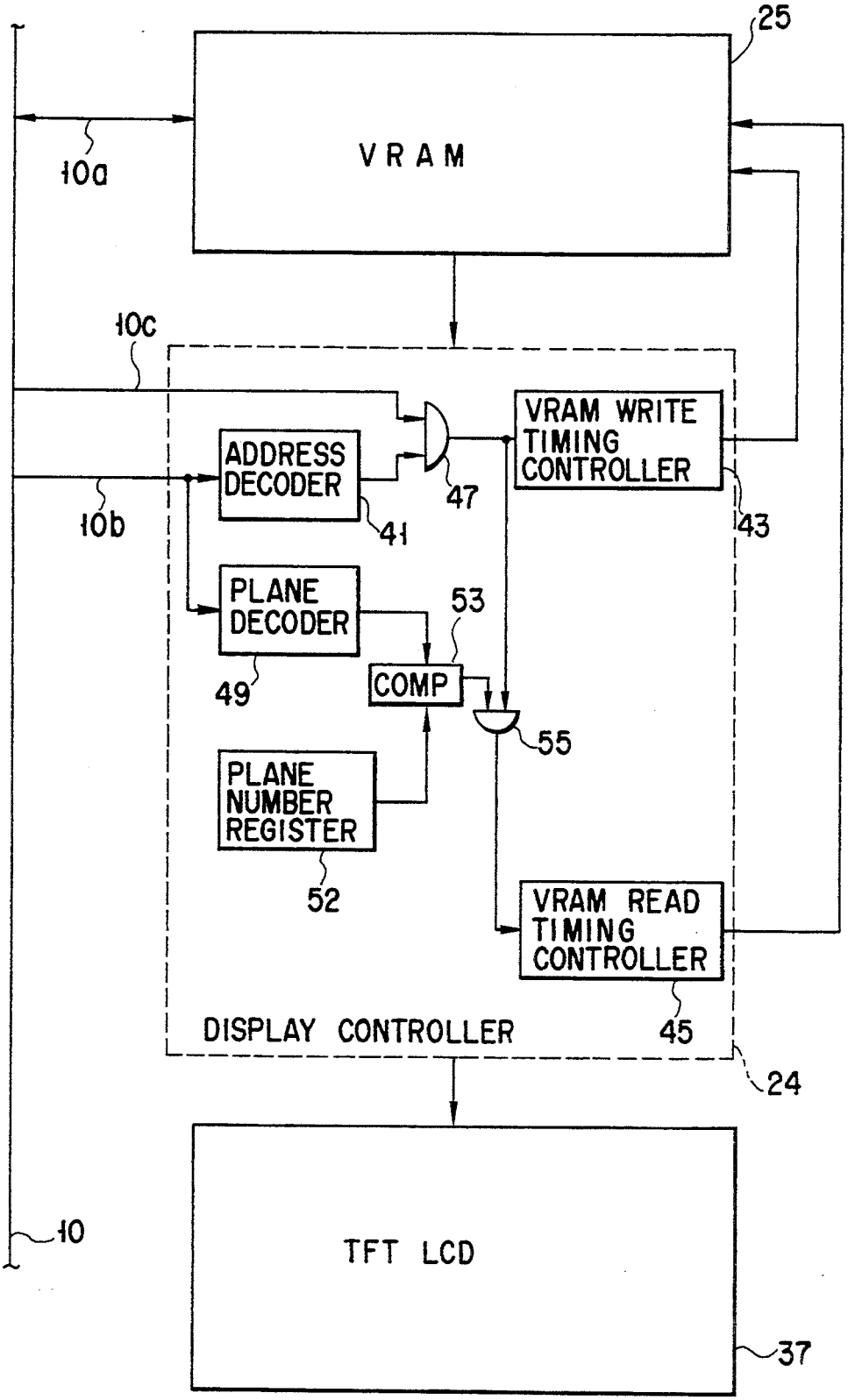
FIG. 4 is a block diagram showing another embodiment of the display controller shown in FIG. 1.

FIG. 4 is a block diagram showing the second embodiment of the present invention. The same reference numerals in FIG. 4 denote the same parts as in FIG. 2, and a detailed description thereof will be omitted.

In the embodiment shown in FIG. 4, a function of inhibiting a read operation of display data from the VRAM 25 when a rewrite operation that does not influence a display content of the LCD 37 is performed in the VRAM 25 is added to the first embodiment.

In general, the VRAM 25 is constituted by one or a plurality of memory planes. One plane means a video RAM for storing display data for one frame. The display controller 24 selects an arbitrary plane from the plurality of planes, and causes the LCD 37 to display given display data. A plane decoder 49 decodes an address signal input through the address bus 10b, and outputs a plane number. A plane number register 52 stores the plane number of a screen display content, which is being displayed on the LCD 37, and outputs the plane number. A comparator 53 compares the number output from the plane decoder 49, and the number output from the plane number register 52, and outputs a high-level signal "H" when the two numbers coincide with each other.

The operation of the second embodiment will be described below.

The plane decoder 49 converts address data supplied from the CPU 11 through the address bus 10*b* into a plane number, and outputs the plane number to the comparator 53. The plane number register 52 outputs the plane number to the comparator 53. The comparator 53 compares the two plane numbers, and outputs a high-level signal "H" when a coincidence between the two numbers is found. The high-level signal "H" is output to an AND gate 55. An output signal from the AND gate 47 obtained in the same manner as in the first embodiment is also supplied to the AND gate 55. The AND gate 55 outputs a high-level signal "H" to the VRAM read timing controller 45 only when both the input signals are high-level signals "H". More specifically, only when data is written in the memory plane, whose content is being displayed, the AND gate 55 outputs a high-level signal "H".

As a result, when display data is written in a plane, which does not influence a memory plane which is being displayed on the LCD 37, new display data need not be supplied to the LCD 37, and power consumption can be saved. Note that a controller for setting a read operation of display data in a sleep state is substantially the same as that shown in FIG. 3, except that a sleep/release signal to be supplied to the sleep/release timing generator 83 is supplied not from the AND gate 47 but from the AND gate 55.

The third embodiment of the present invention will be described below with reference to FIG. 5 and FIGS. 6A through 6H. In the third embodiment, a function of inhibiting display data from being supplied from the VRAM 25 to the LCD 37 when display data to be written in the VRAM 25 is the same data is added to the first embodiment.

Figure 5:
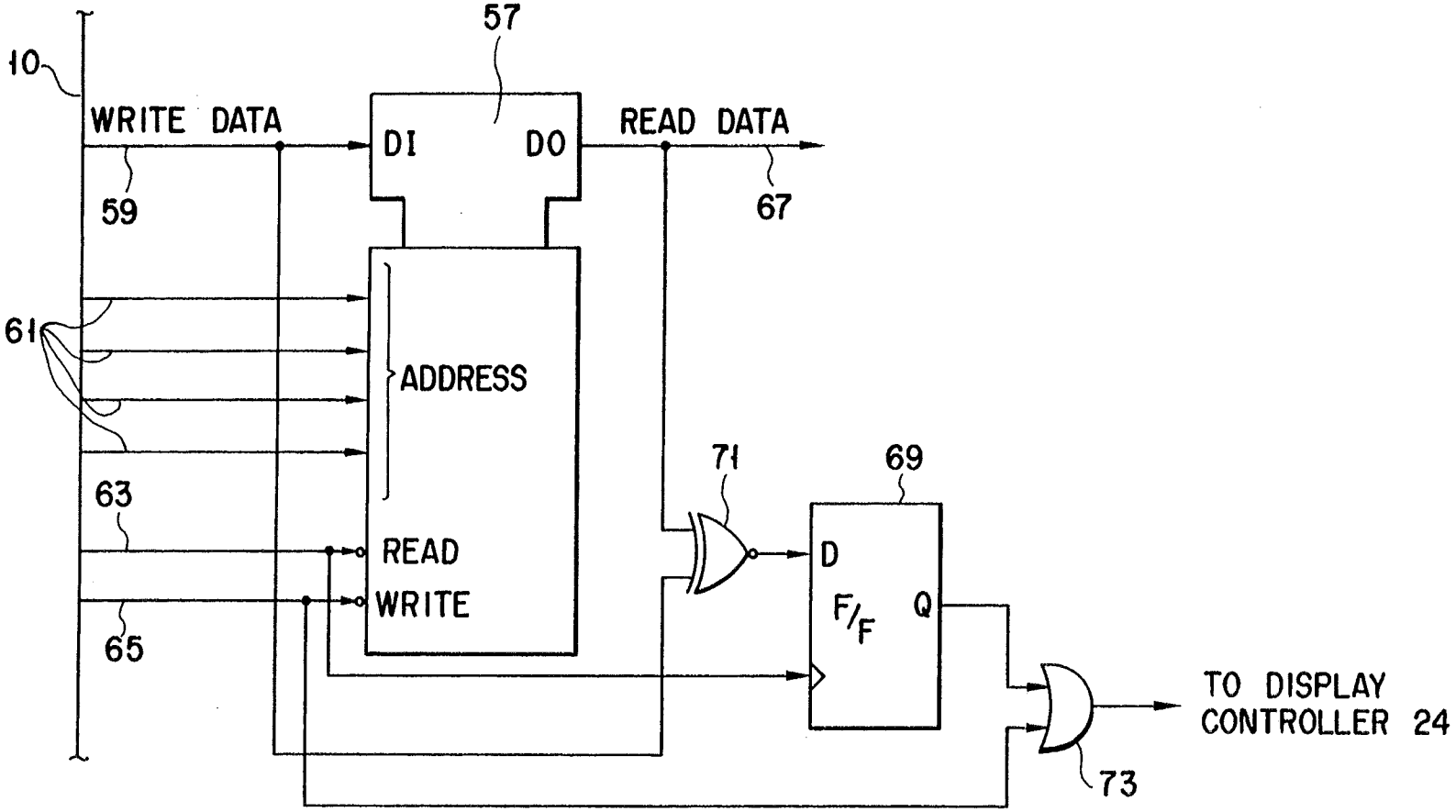
FIG. 5 is a block diagram showing peripheral circuits of a VRAM 5 according to the third embodiment of the present invention.

FIG. 5 shows peripheral circuits of the VRAM 25.

A VRAM chip 57 is connected to a write data line 59, an address line 61, a read line 63, and a write line 65 as lines for receiving signals, and is also connected to a read data line 67 as a line for outputting signals. When a read signal is input, a flip-flop 69 holds a signal from an exclusive OR gate 71, and outputs the held signal to an OR gate 73.

The operation of the third embodiment will be described below.

When the CPU 11 rewrites data in the VRAM 25, it outputs an address signal (FIG. 6A) onto the address line 61, a write data signal (FIG. 6D) onto the write data line 59, and a read signal (FIG. 6B) onto the read line 63. In response to the read signal, the VRAM chip 57 outputs data corresponding to the address signal onto the read data line 67, as shown in FIG. 6C. When the write data signal is the same as the read data signal, the exclusive OR gate 71 outputs a high-level signal "H" to the flip-flop 69, as shown in FIG. 6F. The flip-flop 69 fetches the high-level signal "H" from the exclusive OR gate 71 at the leading edge of the read signal, as shown in FIG. 6G, and outputs it to the OR gate 73.

Thereafter, the CPU 11 outputs a write signal (FIG. 6E) onto the write line 65. When the write signal goes to low level "L", the already supplied write data signal is written at the designated address of the VRAM chip 57. The OR gate logically ORs the write signal and the output from the flip-flop 69, and outputs the ORed result to the timer 77, as shown in FIG. 6H.

Assume that the read data signal and the write data signal do not coincide with each other. In this case, the exclusive OR gate 71 outputs a low-level signal "L" to the flip-flop 69. The flip-flop 69 latches the low-level signal "L" at the leading edge of the read signal, and outputs it to the OR gate 73. Therefore, the OR gate 73 logically ORs the low-level signal from the flip-flop 69 and an active-low write signal, and outputs a low-level signal to the display controller 24. In response to this low-level signal, the display controller 24 reads out display data from the VRAM 25, and supplies readout data to the LCD 37.

A case will be explained below wherein read and write data coincide with each other.

When the two data coincide with each other, the exclusive OR gate 71 outputs a high-level signal "H" to the flip-flop 69. The flip-flop 69 fetches the high-level signal at a timing of the leading edge of the read signal, and outputs it to the OR gate 73. The OR gate 73 receives an active-low write signal. As a result, the OR gate 73 supplies a high-level signal "H" to the display controller 24. Since the display controller 24 responds to the active low-level signal, it is not operated in response to the high-level signal "H". More specifically, the display controller 24 does not read out display data from the VRAM 25 to supply it to the LCD 37.

In this manner, when display data stored in the VRAM 25 is the same as display data to be rewritten, an operation for rewriting the content of the LCD 37 can be omitted, thus saving power consumption.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A display control system, comprising:

a video random access memory (VRAM) for storing video data;

a display device that comprises a thin film transistor active-matrix-type liquid crystal display for holding display data output from said VRAM in units of pixels and displaying the video data;

a VRAM write timing controller for controlling write timings of the video data into the VRAM;

a VRAM read timing controller for controlling read timings for reading out the video data from the VRAM; and an address decoder for decoding an address of the VRAM and outputting an enable signal to the VRAM write timing controller or the VRAM read timing controller in accordance with a command occurring when the decoded output indicates an address of the VRAM, to thereby supply the video data from the VRAM to the display device only when the video data in the VRAM is changed.

2. A display control system, comprising:

a video random access memory (VRAM) comprising a plurality of memory planes for storing video data;

a display device that comprises a thin film transistor active-matrix-type liquid crystal display for holding display data output from said VRAM in units of pixels and displaying the video data;

a VRAM write timing controller for controlling write timings of video data into the VRAM;

a VRAM read timing controller for controlling read timings for reading out video data from the VRAM;

an address decoder for decoding an address of the VRAM;

a plane decoder for decoding a designation to obtain a plane number;

a comparator for comparing the plane number from the plane decoder with a stored plane number of video data being displayed; and an enabling circuit for enabling the VRAM read timing controller when an output from the address decoder indicates an address of the VRAM occurring with a write command and an output from the comparator indicates that the plane number from the plane decoder coincides with the stored plane number and for inhibiting a read operation of display data from the VRAM when a rewrite operation that would not change display content of the liquid crystal display is performed because the plane numbers do not coincide.

3. A display control system, comprising:

a video random access memory (VRAM) for storing video data;

a display device that comprises a thin film transistor active-matrix-type liquid crystal display for holding display data output from said VRAM in units of pixels and displaying the video data;

a display controller for reading out video data from the VRAM and supplying it to the display device; and a detector for detecting rewriting of video data in the VRAM and detecting that the rewritten video data is the same as video data as before rewriting and outputting a disable signal to the display controller, to thereby inhibit display data from being supplied from the VRAM to the display device when the video data to be written in the VRAM and the display data are the same.

* * * * *